US005914563A

United States Patent [19]

Lee et al.

[11] Patent Number: 5,914,563

[45] Date of Patent: Jun. 22, 1999

[54] PLASMA DISPLAY PANEL WITH PLURAL SCREENS

[75] Inventors: Eun-Cheol Lee; Young-Bok Song; Bong-Koo Kang; Young-Hwan Kim, all of Kyongsangbuk-do, Rep. of Korea

[73] Assignee: LG Electronics Inc., Seoul, Rep. of Korea

[21] Appl. No.: 08/921,608

[22] Filed: Sep. 2, 1997

[30] Foreign Application Priority Data

Sep. 3, 1996 [KR] Rep. of Korea ..... 96-38013

[51] Int. Cl.[6] ..... H01J 17/49

[52] U.S. Cl. ..... 313/585; 313/582; 313/584; 313/586

[58] Field of Search ..... 313/582, 584, 313/585, 586, 243, 245, 250, 257

*Primary Examiner*—Vip Patel

*Attorney, Agent, or Firm*—Finnegan, Henderson, Farabow, Garrett & Dunner, L.L.P.

[57] ABSTRACT

It is the main objective of the present invention to provide a plasma display panel designed to use a common electronic device, wherein a large size screen of the plasma display panel is divided by maintaining a stable discharge state of each cell and decreasing the data amount of the operating circuits in which the divided screens are operated in parallel simultaneously. To accomplish the above objective, a plasma display panel is provided having a common electrode, a scanning electrode, and a data electrode being disposed between an upper substrate and a lower substrate. The common electrode is arranged parallel to the scanning electrode, and the data electrode is arranged perpendicular to the common electrode and the scanning electrode. A cell is at the intersection where the common electrode and the scanning electrode intersect with the data electrode. The data electrode is divided for the purpose of dividing the plasma display panel into plural screens.

7 Claims, 6 Drawing Sheets

PLASMA DISPLAY PANEL WITH PLURAL SCREENS

BACKGROUND OF THE INVENTION

1. Field of the Invention

The present invention generally relates to a plasma display panel, more particularly to a plasma display panel capable of: dividing one screen of the plasma display panel into a plurality of smaller screens, the plurality of smaller screens operating independently at the same time, whereby each panel cell keeps a state of stable discharge; and decreasing the sharing data of working circuits, whereby it is possible to design circuits with common electronic devices so that it is cheaper to manufacture and easy to design circuits.

2. Description of the Related Art

As shown in FIG. 1, an electrode array of a general three-electrode surface-discharge Plasma Display Panel includes scanning electrodes 2 where a scanning pulse is applied during an address period, common electrodes 3 where a sustaining pulse is applied in order to sustain discharge state, and data electrodes 1 where a data pulse is applied in order to generate sustaining discharge between selected scanning electrodes 2 and the common electrodes 3. A cell 5 is formed at each intersection where a vertical electrode, one pair of the scanning electrodes 2, and the common electrodes 3 intersect with a horizontal electrode and data electrodes 1. The plasma display panel is formed by the aggregation of such a plurality of cells.

FIG. 4 is a partial sectional view of a plasma display panel.

Referring to FIG. 4, a discharge space 20 is formed between barrier ribs 16 which support a horizontal electrode 14 and a vertical electrode 19. Phosphor 17 is formed over the vertical electrode 19. Reference numerals 12 and 13 designate substrates, and reference numerals 15 and 18 designate insulating layers.

FIG. 2 is a timing chart of signals to operate the plasma display panel. A sustaining pulse 7 is applied to the common electrodes 3 of Cl–Cn. A sustaining pulse 8 having the same cycle as the sustaining pulse 7 is also applied to the scanning electrodes 2 of Sl–Sn, but it has different timing from the pulse of the common electrodes 3.

A scanning pulse 10 and an extinguishing pulse 9 are also supplied to respective scanning electrodes. A data pulse 11 is applied to data electrodes of Dl–Dn at the same time as the scanning pulse is applied to the scanning electrodes.

In order to light the cell 5 where the scanning electrodes 2 intersect with the data electrodes 1, a data pulse 11 synchronized with the scanning pulse 10 applied to the scanning electrode 2 should be supplied to the data electrodes 1. As a result, discharge occurs at the cell 5 and is maintained by the sustaining pulses 7 and 8 which are supplied to the common electrode 3 and the scanning electrodes 2, and it is completed by an extinguishing pulse 9.

In a method operating one screen as shown in FIG. 1 using a single operating circuit, a pulse width for operating respective cells of the plasma display panel varies with respective cell properties. A general scanning pulse, however, has the width of around 2.5 μs. As shown in FIG. 2, since there should be provided a time interval in order that one scanning pulse 11 and two sustaining pulses (7+8) can be applied in one sustaining period. A possible minimum period of the sustaining pulse is 5.5 μs, which is calculated as follows:

$$2.5\ \mu s\ (\text{width of the scanning pulse } 10)+1.5\ \mu s\ (\text{width of the sustaining pulse } 7)+1.5\ \mu s\ (\text{width of the sustaining pulse } 8)=5.5\ \mu s \quad (1)$$

This time is also a period of a data pulse required for applying a data pulse to the scanning electrodes on a next scanning line after the data pulse has been applied to scanning electrodes on one scanning line.

It takes 1/60 second in scanning one field in a NTSC television signal of an interlaced scanning method.

When the number of the scanning electrodes 2 of a plasma display panel is given to N, since one field in a 256 gray scale is composed of eight subfields, an interlaced scanning mode should satisfy the equation below:

$$5.5\ \mu s \times N/2 \times NfS \leqq 1/60\ \text{sec} \quad (2)$$

wherein N is the number of the scanning electrodes, and NfS is the number of subfields making one field.

From the above equation (2), when eight subfields make one field, in other words, NfS=8, the allowable maximum number of the scanning electrodes becomes 757.

A plasma display panel, one of the flat display devices is developed as a large size wall-hanging display device because it is easy to achieve a large picture display size in its aspects of panel structure. One problem in fabricating and operating a large-sized screen display device is that more pixels have to be given to one screen according to the increase in screen size. The increase in the number of pixels means the increase in a data amount to be processed in one frame. A flat display device for a high definition television has to satisfy the requirements of having 256 gray levels and a resolution of 1280×1024 and higher. In order to satisfy the above requirements, a vast data amount of about one gigabit per second must be processed.

The periods of the data pulse and the sustaining pulse to satisfy the resolution of 1280×1024 can be obtained from equation (2), and the equation (3) below comes out.

$$Ts1 \leqq 1/60\ \text{sec} \div N/2 \div 8 \quad (3)$$

Thus, in order to operate a large size television having 1024 horizontal electrodes, the period of the sustaining pulse has to satisfy the equation Ts1<4 μs.

In order to decrease the period of the sustaining pulse, the turn-on time of cells in a display panel has to be decreased. When the decrease in the widths of the sustaining pulse and the scanning pulse is excessive, the discharge state of cells of the plasma display panel becomes unstable. Thus, it is impossible to decrease the pulse width below a certain time required for the discharge. This limits the number of electrodes which can be operated at the same time and acts as an important limitation in making a large size display device.

In addition, a high speed electronic device made of GaAs should be used in order to process a large amount of data such as one gigabit. In case the electronic device is used, the cost of driving circuits is high, which is a problem in the plasma display panel business.

Another hindrance in designing the driving circuit is a response time of the driving circuit. In order to operate the plasma display panel by a subfield method, eight bits of data have to be stored in a field memory and then the same weight bits have to be sequentially transferred to a serial to parallel converter (SPC) one by one.

When the pixel number of the plasma display panel is M×N, a data amount of M×N×8 should be transferred to the SPC during one field. Therefore, the time Td1 required for transferring one bit is defined by equation (4) below:

$$M \times N/2 \times 8 \times Td1 < 1/60 \text{ sec} \quad (4)$$

Accordingly, the time Tdl is obtained from the substitution of M=1280 and N=1024 in equation (4) and comes out about 3.2 nsec. SPC can be made using a flip flop. In considering that Td1 of a flip flop in common use is approximately 8 nsec, a SPC has to be specifically designed using a GaAs device which is 2.5 times faster than the flip flop in common use.

However, the GaAs device is very expensive compared to a common electronic device, so it is difficult to design an inexpensive operating circuit by using the GaAs device.

SUMMARY OF THE INVENTION

To overcome the above problem, the main objective of the present invention is to provide a plasma display panel design using common electronic devices, wherein a large-sized screen of the plasma display panel is divided by maintaining a stable discharge state of each cell and by decreasing each data amount of the operating circuits. The divided screens are operated in parallel at the same time.

To accomplish the above objective, a plasma display panel is provided having a common electrode, a scanning electrode, and a data electrode being disposed between an upper substrate and a lower substrate. The common electrode is arranged parallel to the scanning electrode, and the data electrode is arranged perpendicular to the common electrode and the scanning electrode. A cell is at the intersection where the common electrode and the scanning electrode intersect with the data electrode. The data electrode is divided for the purpose of dividing a screen.

BRIEF DESCRIPTION OF THE DRAWINGS

Further objectives and advantages of the present invention will be apparent from the following description referring to the accompanying drawings, wherein preferred embodiments of the present invention are clearly shown.

In the Drawings.

DETAILED DESCRIPTION OF THE INVENTION

Hereinbelow, one embodiment of the present invention will be described referring to the enclosed drawings.

Figure 5:
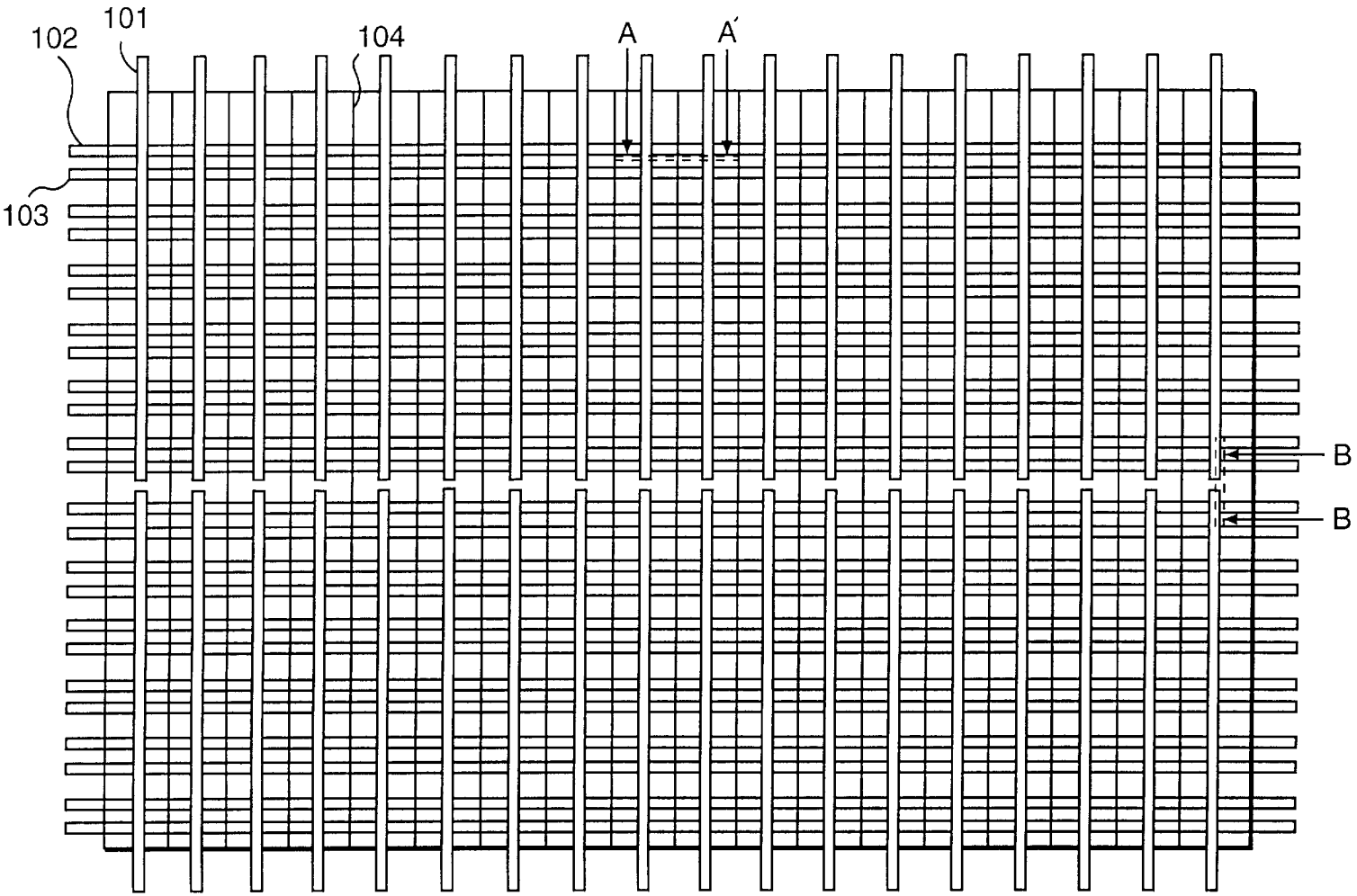
FIG. 5 is a view showing an electrode arrangement of a plasma display panel according to the present invention.

As to four divided screens in FIG. 5, a perpendicular electrode of a data electrode 101 is divided into an upper portion and a lower portion. A horizontal electrode of a common electrode 103 and a scanning electrode 102 are divided into a left portion and a right portion by a barrier rib 104.

Figure 7:
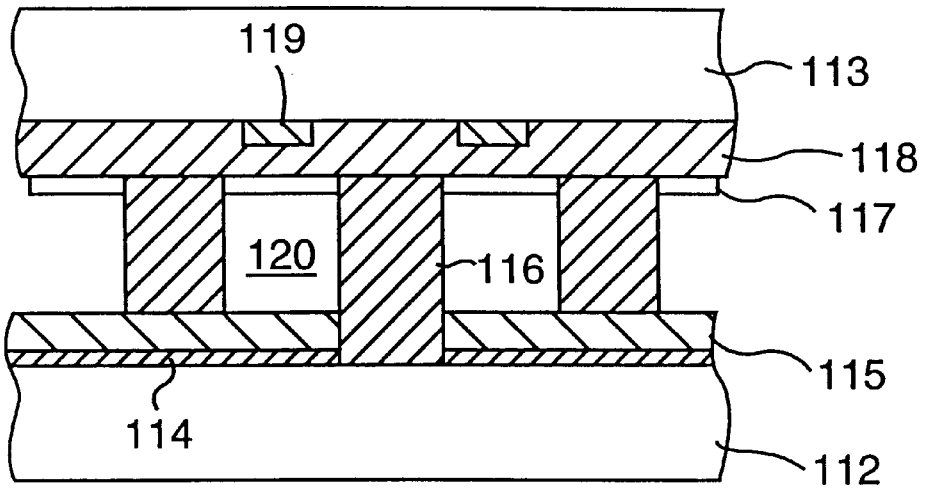
FIG. 7 is a sectional view taken along the line A–A' of FIG. 5.

FIG. 7 is a sectional view taken along the line A–A' of FIG. 5. Referring to FIG. 7, a barrier rib 116 divides an insulating layer 115 and the horizontal electrode 114 (common and scanning electrodes 103 and 102 in FIG. 5) into a left portion and a right portion.

Figure 8:
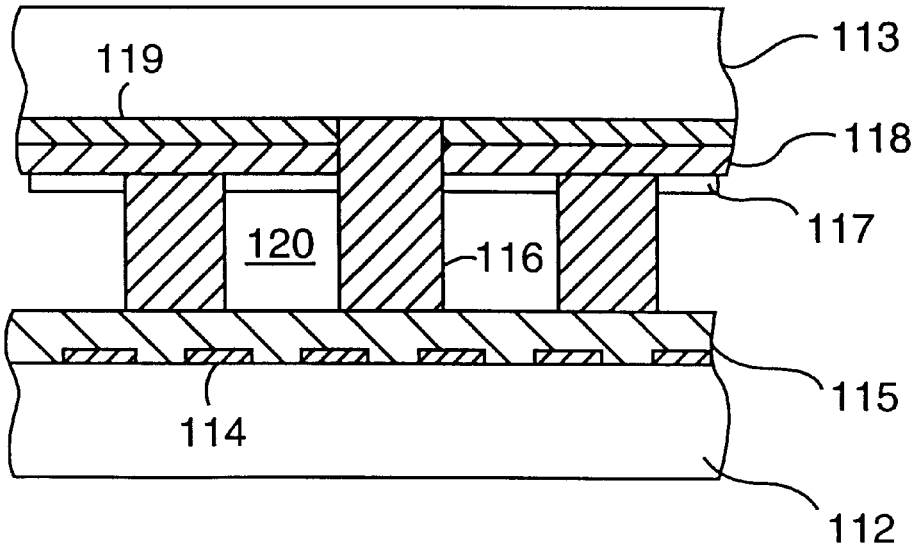
FIG. 8 is a sectional view taken along the line B–B' of FIG. 5.

FIG. 8 is a sectional view taken along the line B–B' of FIG. 5 in the event the barrier rib 116 is formed along the horizontal direction of a panel. Referring to FIG. 8, a perpendicular electrode 119 (data electrode 101 in FIG. 5) is divided into an upper portion and a lower portion by the barrier rib 116 to create two division screens.

Thus, the panel becomes four divided screens consisting of two screens of a horizontal electrode 114 and two screens of a perpendicular electrode divided by barrier ribs 116, respectively. Reference numeral 117 is phosphor, and reference numeral 118 is an insulating layer.

Hereinbelow, operation of the present invention is described.

When a plasma display panel which has 757 and over scanning electrodes is operated by a sole operation circuit, the period of the sustaining pulse becomes around 4.0 μsec and below, whereby the discharge of cells in the plasma display panel becomes unstable. This is an important limitation in making large screens.

Accordingly, in order to sustain the stable discharge of each cell, the period of the sustaining pulse has to be maintained above a certain time. This requirement limits the number of electrodes capable of being operated at the same time. With the intention of solving this problem, a large screen is divided into two small screens being concurrently operated by a parallel operation method shown in FIG. 6.

First, the method of dividing the screen into an upper portion and a lower portion is described below.

When a display device, such as a high definition television with the resolution of 1280×1024 whose one field is composed of eight subfields, is operated, an allowable period Ts2 of the sustaining pulse is obtained from equation (3) and becomes the equation below:

$$Ts2 \leqq 1/60 \text{ sec} \div N/2 \div 8$$

Since the screen is divided into two portions, N=1024/2=512 is substituted in the above equation. Therefore, the allowable period Ts2 is $$Ts2 < 8.14\ \mu s$$

This means that the period of the sustaining pulse can be increased twice compared to Ts1≦4 μs for the conventional art.

Accordingly, when a display element with the same resolution of 1280×1024 is operated according to the method of the present invention, the period of the sustaining pulse is increased twice compared to the conventional art, thereby satisfying a minimum requirement time necessary for discharge which is given from the discharge characteristic of the cell of the plasma display panel.

Figure 1:
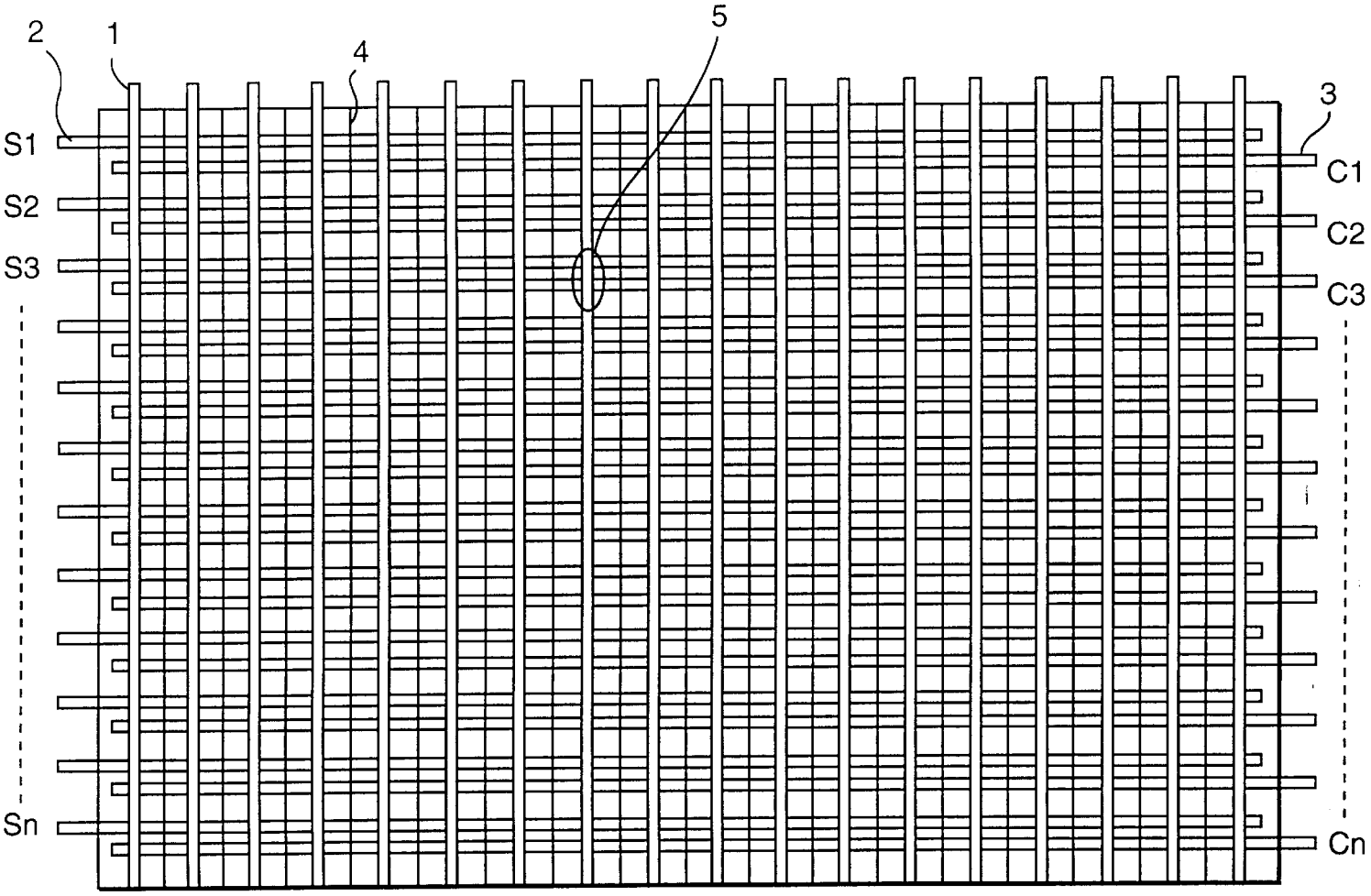
FIG. 1 (PRIOR ART)
FIG. 1 is a view showing an electrode arrangement of a plasma display panel according to conventional art.
Figure 2:
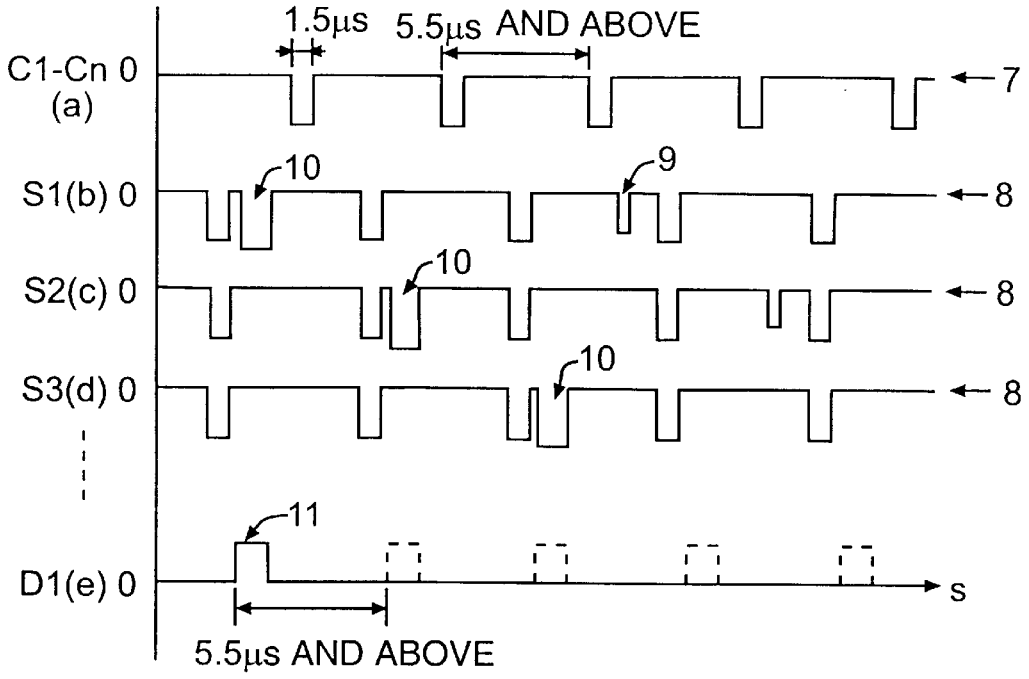
FIG. 2 PRIOR ART
FIG. 2 is a timing chart of an operating signal according to conventional art.
Figure 3:
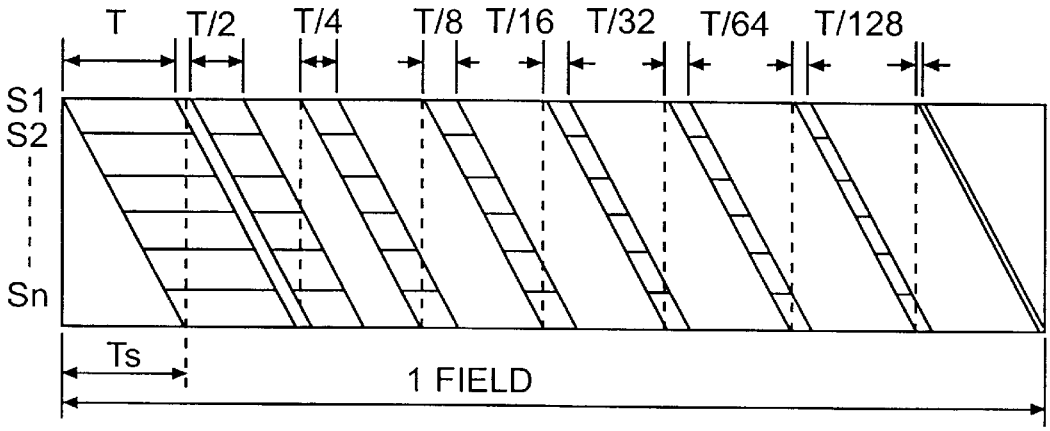
FIG. 3 PRIOR ART
FIG. 3 is a view showing a scanning method of subfields for 256 gray scale.
Figure 4:
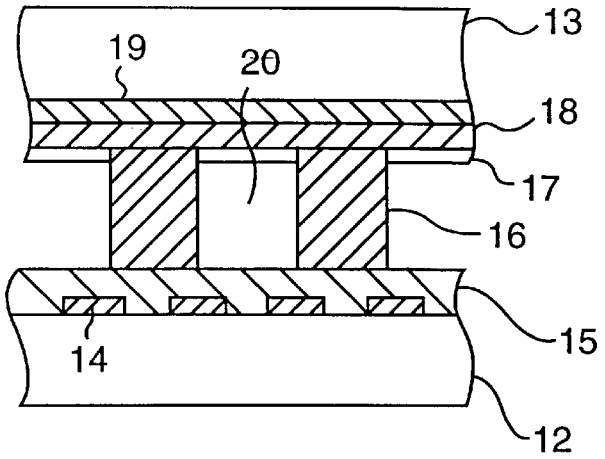
FIG. 4 (PRIOR ART)
FIG. 4 is a partial sectional view of a plasma display panel according to conventional art.
Figure 6:
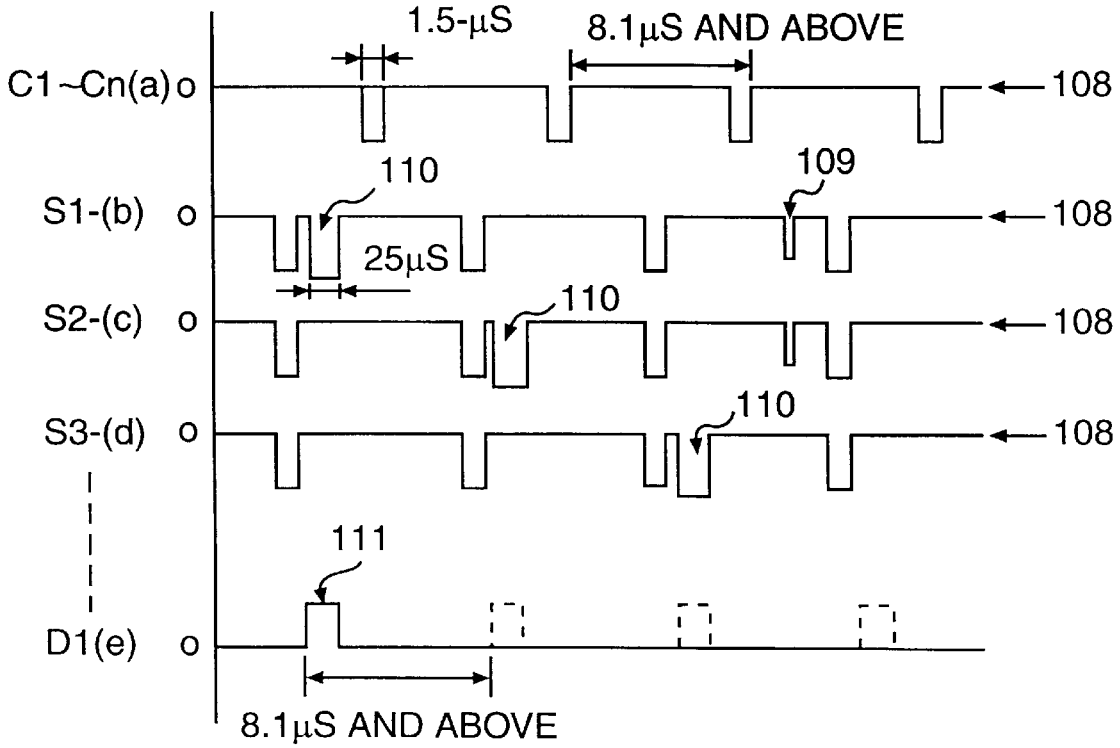
FIG. 6 is a timing chart of an operating signal provided in the present invention.

A timing chart of an operation signal according to the present invention is shown in FIG. 6.

The present invention can also resolve a limiting condition of responding time which is a problem in the conventional art.

When a display device with the resolution of 1280×1024 is operated according to the conventional operating method, the time taken in transferring a signal of 1 bit to a serial to parallel converter is Td1<3.2 ns, whereas when the display device is operated according to the present invention, the time Td4 can be obtained by substituting M=1280, N=1024 for the above mentioned equation (4) and becomes $$Td4<12.8 \text{ ns} \quad (5)$$

Therefore, the present invention can employ the serial to parallel converter using a common flip flop whose delay time is generally 8 ns.

Figure 9:
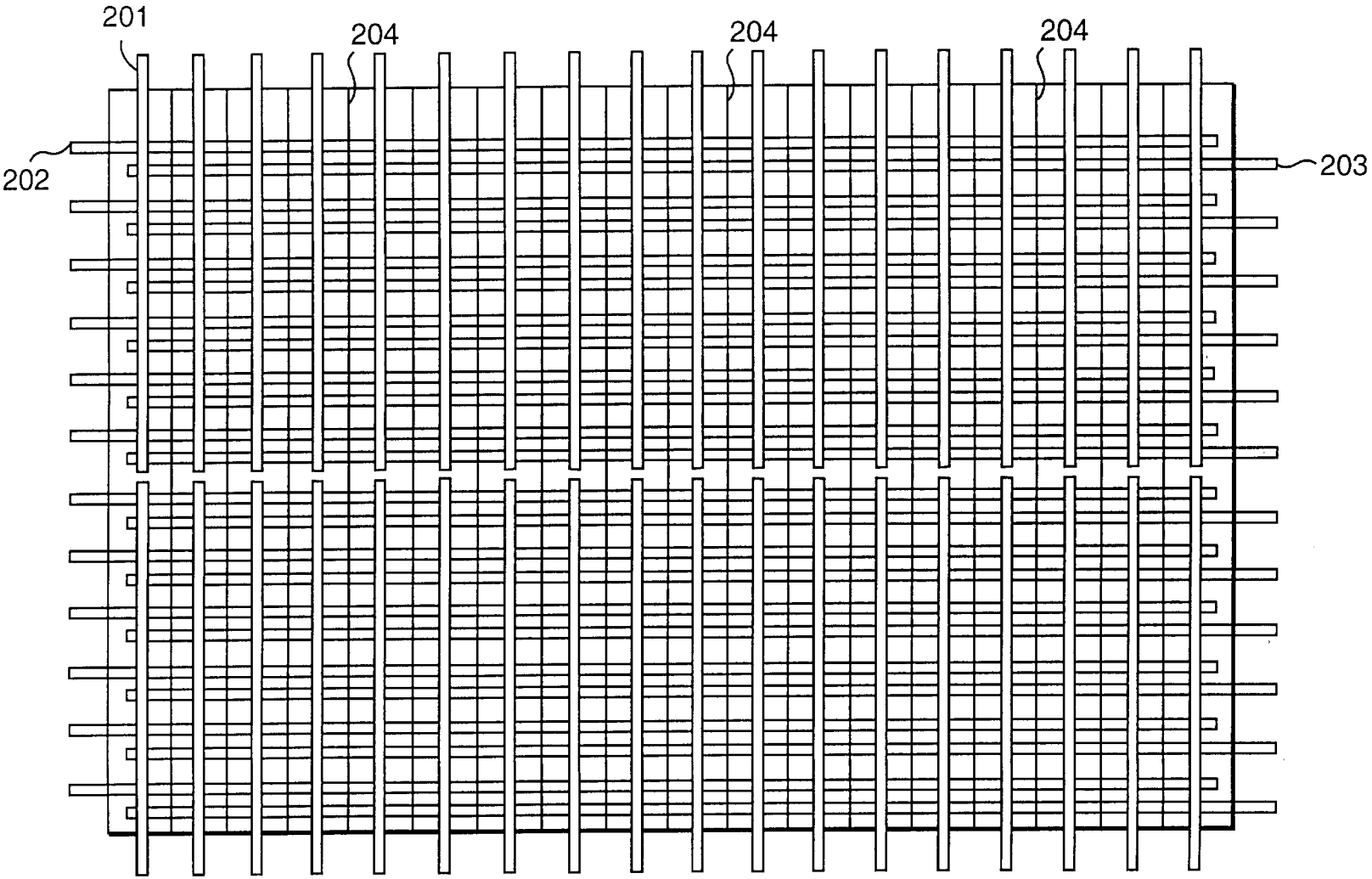
FIG. 9 is a view showing an electrode arrangement of a plasma display panel according to another embodiment of the present invention.

According to another embodiment of the present invention as shown in FIG. 9, the present invention is not limited to four smaller screens, but it can also be divided into a plurality of smaller screens by barrier ribs 204.

As described previously, the present invention divides one screen of a plasma display panel into a plurality of smaller screens and operates the divided plurality of screens independently at the same time. As a result, it increases the period of the sustaining pulse, thereby not only maintaining a stable discharge state of cells, but also processing a large amount of field data through the divided plurality of screens.

Accordingly, manufacturers can make an operating circuit capable of processing a large amount of field data followed by a large-sized screen by using common electronic devices instead of using an expensive specific electronic device.

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

What is claimed is:

1. A plasma display panel comprising:

a common electrode positioned parallel to a scanning electrode;

a data electrode positioned perpendicular to the common electrode and the scanning electrode;

a cell positioned at the intersection where the common electrode and the scanning electrode intersect with the data electrode; and the data electrode being divided for the purpose of dividing the screen into a plurality of smaller screens.

2. The plasma display panel as claimed in claim 1, wherein the common electrode and the scanning electrode are divided by at least one barrier rib, thereby further dividing the smaller screens into a plurality of still smaller screens.

3. The plasma display panel as claimed in claim 1, wherein the data electrode is divided by a barrier rib.

4. A plasma display panel divided into a plurality of smaller screens and the plurality of smaller screens operating independently at the same time, comprising:

a common electrode positioned parallel to a scanning electrode;

a data electrode positioned perpendicular to the common electrode and the scanning electrode;

a cell positioned at the intersection where the common electrode and the scanning electrode intersect with the data electrode; and the data electrode being divided for the purpose of dividing the plasma display panel.

5. The plasma display panel as claimed in claim 4, wherein the common electrode and the scanning electrode are divided by at least one barrier rib, thereby dividing one screen into the plurality of smaller screens.

6. The plasma display panel as claimed in claim 4, wherein the data electrode is divided by a barrier rib.

7. The plasma display panel of claim 4 made by the steps of:

disposing a common electrode, a scanning electrode and a data electrode between an upper substrate and a lower substrate;

arranging the common electrode parallel to the scanning electrode;

arranging the data electrode perpendicular to the common electrode and the scanning electrode;

positioning a cell at an intersection where the common electrode and the scanning electrode intersect with the data electrode; and dividing the data electrode for the purpose of dividing the plasma display panel.

* * * * *

US005914563C1

(12) EX PARTE REEXAMINATION CERTIFICATE (5801st)

United States Patent

Lee et al.

(10) Number: US 5,914,563 C1

(45) Certificate Issued: Jul. 3, 2007

(54) PLASMA DISPLAY PANEL WITH PLURAL SCREENS

(75) Inventors: Eun-Cheol Lee, Kyongsangbuk-do (KR); Young-Bok Song, Kyongsangbuk-do (KR); Bong-Koo Kang, Kyongsangbuk-do (KR); Young-Hwan Kim, Kyongsangbuk-do (KR)

(73) Assignee: LG Electronics Inc., Seoul (KR)

Reexamination Request:
No. 90/006,827, Oct. 24, 2003

Reexamination Certificate for:

| | |
|---|---|
| Patent No.: | **5,914,563** |
| Issued: | **Jun. 22, 1999** |
| Appl. No.: | **08/921,608** |
| Filed: | **Sep. 2, 1997** |

(30) Foreign Application Priority Data

Sep. 3, 1996 (KR) ..... 96-38013

(51) Int. Cl.
*H01J 17/49* (2006.01)

(52) U.S. Cl. ..... 313/585; 313/582; 313/584; 313/586

(58) Field of Classification Search ..... 313/582–587; 345/60; 315/169.1, 169.3
See application file for complete search history.

(56) References Cited

U.S. PATENT DOCUMENTS

| | | | |
|---|---|---|---|
| 4,223,623 | A | 9/1980 | Brunet et al. |
| 4,320,418 | A | 3/1982 | Pavliscak |
| 4,426,646 | A | 1/1984 | Yamaguchi et al. |
| 5,155,414 | A | 10/1992 | Sano |
| 5,187,578 | A | 2/1993 | Kohgami et al. |
| 5,684,499 | A | 11/1997 | Shimizu et al. |
| 5,903,245 | A | 5/1999 | Shimizu et al. |
| 5,952,783 | A | 9/1999 | Kuroki et al. |

FOREIGN PATENT DOCUMENTS

| | | |
|---|---|---|
| EP | 0444962 B1 | 9/1991 |
| EP | 0680097 A2 | 11/1995 |
| EP | 0800157 A1 | 10/1997 |
| EP | 0 680 067 | 2/2003 |
| JP | 53-050971 | 5/1978 |

(Continued)

OTHER PUBLICATIONS

Sano, Y, et al.; "A Full Color Surface–Discharge ac Plasma TV Display," NEC Corporation, Kawasaki, Japan, SID 91 Digest, pp. 728–731; ISSN0097–0966X191, no month.

Saegusa et al., "Development of 40inch AC Plasma Display Panel", 1996 ITE Annual Convention; including English language translation, no month.

Shinoda, Tsutae, "Plasma Display Panels", accepted for publication Oct. 23, 1992.

T. Yamamoto, T. Kuriyama, M. Seki, T. Katoh, H. Murakzmi; Digital HDTV Plasma Display; May 16, 1993; XP 00047073; SID 93 Digest; Japan.

*Primary Examiner*—Joseph Williams

(57) ABSTRACT

It is the main objective of the present invention to provide a plasma display panel designed to use a common electronic device, wherein a large size screen of the plasma display panel is divided by maintaining a stable discharge state of each cell and decreasing the data amount of the operating circuits in which the divided screens are operated in parallel simultaneously. To accomplish the above objective, a plasma display panel is provided having a common electrode, a scanning electrode, and a data electrode being disposed between an upper substrate and a lower substrate. The common electrode is arranged parallel to the scanning electrode, and the data electrode is arranged perpendicular to the common electrode and the scanning electrode. A cell is at the intersection where the common electrode and the scanning electrode intersect with the data electrode. The data electrode is divided for the purpose of dividing the plasma display panel into plural screens.

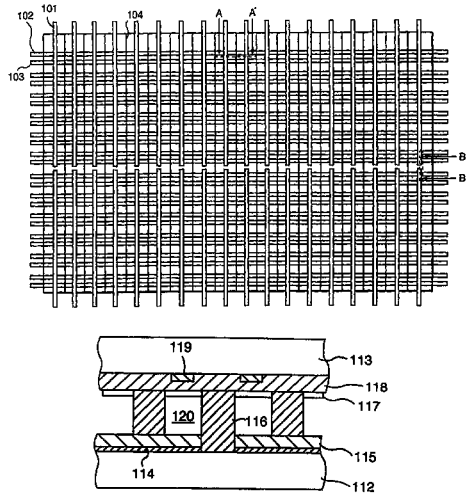

FOREIGN PATENT DOCUMENTS

| | | |
|---|---|---|
| JP | 55-29852 | 3/1980 |
| JP | S61-045532 | 3/1986 |
| JP | 63-018331 | 1/1988 |
| JP | 63-314744 | 12/1988 |
| JP | 01-200394 | 8/1989 |
| JP | H01-233492 | 9/1989 |
| JP | 02-136889 | 5/1990 |
| JP | 02-152138 | 6/1990 |
| JP | H02-244880 | 9/1990 |
| JP | H03-145691 | 6/1991 |
| JP | H06-276400 | 6/1991 |
| JP | 04-018594 | 1/1992 |
| JP | 04-042289 | 2/1992 |
| JP | H06-04039 | 1/1994 |
| JP | 07-199858 | 8/1995 |
| JP | H09-274859 | 3/1996 |
| JP | 09-274859 | 10/1997 |

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 4 and 6 are determined to be patentable as amended.

Claims 2, 3, 5 and 7, dependent on an amended claim, are determined to be patentable.

New claims 8-104 are added and determined to be patentable.

1. A plasma display panel comprising:

a common electrode positioned parallel to a scanning electrode;

a data electrode positioned perpendicular to the common electrode and the scanning electrode;

a cell positioned at the intersection where the common electrode and the scanning electrode intersect with the data electrode; and the data electrode being divided for the purpose of dividing the screen into a plurality of smaller screens, *wherein a common electrode signal is applied to the common electrode when the cell is selected, and the same common electrode signal is applied when the cell is not selected, and wherein the data electrode is divided by a separation, and a barrier rib is located between the separation.*

4. A plasma display panel divided into a plurality of smaller screens and the plurality of smaller screens operating independently at the same time, comprising:

a common electrode positioned parallel to a scanning electrode;

a data electrode positioned perpendicular to the common electrode and the scanning electrode;

a cell positioned at the intersection where the common electrode and the scanning electrode intersect with the data electrode; and the data electrode being divided for the purpose of dividing the plasma display panel, *wherein a sustain pulse or a common electrode signal is applied to the common electrode when the cell is selected and the same sustain pulse or common electrode signal is applied when the cell is not selected, and wherein the data electrode is divided by a separation, and a barrier rib is located between the separation.*

6. The plasma display panel as claimed in claim 4, wherein the data electrode is divided by [a] *the* barrier rib.

*8. A plasma display panel, comprising:*

*a plurality of common electrodes positioned parallel to a plurality of scanning electrodes;*

*a plurality of data electrodes positioned perpendicular to the plurality of common electrodes and the scanning electrodes; and*

*a plurality of cells, each cell being positioned at an intersection where each of the plurality of data electrodes intersect with corresponding common and scanning electrodes, wherein the plurality of data electrodes is divided such that the plurality of data electrodes comprises at least a plurality of first data electrodes and a plurality of second data electrodes, and the first and second data electrodes are electrically separated from each other such that a screen of the plasma display panel is divided into a plurality of smaller screens in a direction parallel to the plurality of common and scanning electrodes.*

*9. The plasma display panel of claim 8, wherein at least one of each common electrode is driven by at least one first sustaining pulse having a first prescribed pulse width (P1), and at least one of each scanning electrode is driven by at least one second sustaining pulse having a second prescribed pulse width (P2) and at least one scanning pulse having a third prescribed pulse width (P3), wherein a first prescribed time period (Ts) comprises at least P1+P2+P3.*

*10. The plasma display panel of claim 9, wherein each of the first, second and third pulse width is based on a first transition of a signal from a first potential to a second potential and a second transition of the signal from the second potential to the first potential.*

*11. The plasma display panel of claim 9, wherein each of the first and second data electrodes is driven by at least one data pulse.*

*12. The plasma display panel of claim 9, wherein Ts is not less than 4 microseconds.*

*13. The plasma display panel of claim 9 or 12, wherein Ts is at least 5.5 microseconds.*

*14. The plasma display panel of claim 13, wherein Ts is at least 8.1 microseconds.*

*15. The plasma display of claim 9, wherein Ts is determined based on the following:*

*Ts×(a resolution in a direction of the scanning electrodes/a prescribed number)×Nfs≦a prescribed time period based on a scanning mode, where Nfs is a number of sub-field.*

*16. The plasma display panel of claim 15, wherein the plurality of smaller screens comprises K number of smaller screens, and the resolution corresponds to a resolution of at least one of K number of smaller screens.*

*17. The plasma display panel of claim 16, wherein the resolution is based on a number of scanning electrode of the at least one of K number of smaller screens.*

*18. The plasma display panel of claim 17, wherein K=2.*

*19. The plasma display panel of claim 17, wherein a resolution of the screen is at least 757 and K is 2 such that the resolution of each smaller screen is an integer number based on 757/2.*

*20. The plasma display panel of claim 19, wherein the resolution of the screen is 1024 and a resolution in a direction of the data electrodes is 1280.*

*21. The plasma display panel of claim 15, wherein the prescribed time period equals 1/60 seconds.*

*22. The plasma display panel of claim 15 or 21, wherein the prescribed number equals 2.*

*23. The plasma display panel of claim 22, wherein the scanning mode is an interlaced scanning mode.*

*24. The plasma display panel of claim 16, wherein Ts increases as K increases.*

*25. The plasma display panel of claim 16, wherein as K increases, a resolution of the screen increases in the direction of the scanning electrodes.*

*26. The plasma display panel of claim 15, wherein Nfs equals 8.*

*27. The plasma display panel of claim 8, wherein a time period (Td) for transferring one bit of information is based on the following:*

*(a first screen resolution of the screen in a direction of the plurality of the data electrodes)×(a first resolution in a direction of the scanning electrodes/a prescribed number)×(a number of bits for a prescribed gray scale)×Td<a prescribed time period based on a scanning mode.*

*28. The plasma display panel of claim 27, wherein the plurality of smaller screens comprises K number of smaller screens, and the first resolution corresponds to a resolution of at least one of K number of smaller screens.*

*29. The plasma display panel of claim 28, wherein the first resolution is based on a number of scanning electrode of the at least one of K number of smaller screens.*

*30. The plasma display panel of claim 29, wherein K=2.*

*31. The plasma display panel of claim 29, wherein a second screen resolution of the screen in a direction of the scanning electrodes is at least 757 and K is 2 such that the first resolution of each smaller screen is an integer number based on 757/2.*

*32. The plasma display panel of claim 31, wherein the first screen resolution is 1280 and the second screen resolution of the screen is 1024.*

*33. The plasma display panel of claim 27, wherein the prescribed time period equals 1/60 seconds.*

*34. The plasma display panel of claim 33, wherein the prescribed number equals 2.*

*35. The plasma display panel of claim 34, wherein the scanning mode is an interlaced scanning mode.*

*36. The plasma display panel of claim 28, wherein Td increases as K increases.*

*37. The plasma display panel of claim 28, wherein as K increases, a second screen resolution of the screen in the direction of the scanning electrodes increases.*

*38. The plasma display panel of claim 27, wherein the number of bits equals 8.*

*39. The plasma display panel of claim 8, wherein the plurality of data electrodes is divided by a spaced distance between the plurality first and second plurality of data electrodes for electrical separation.*

*40. The plasma display panel of claim 39, wherein the plurality of smaller screens comprises a first smaller screen and a second smaller screen, the plurality of first data electrodes of the first screen and the plurality of second data electrodes of the second screen being configured for independent operation of first and second smaller screens.*

*41. The plasma display panel of claim 8, wherein the plurality of common and scanning electrodes are divided at least once by a spaced distanced such that the plurality of common and scanning electrodes comprises a plurality of first common electrodes and a plurality of second common electrodes and plurality of scanning electrodes comprises a plurality of first scanning electrodes and a plurality of second scanning electrodes, thereby further dividing the plurality of smaller screens into a plurality of even smaller screens.*

*42. The plasma display panel of claim 41, wherein the plurality of even smaller screens comprises first, second, third and fourth screens, the first and second screens including the plurality of first common and scanning electrodes and the third and fourth screens including the plurality of second common and scanning electrodes, and wherein the first and third screens includes the plurality of first data electrodes, and the second and fourth screens includes the plurality of second data electrodes.*

*43. The plasma display panel of claim 8, wherein the plurality of common and scanning electrodes are divided by at least one barrier rib, thereby further dividing the smaller screens into a plurality of even smaller screens.*

*44. The plasma display panel of claim 8, wherein the plurality of data electrodes is divided by a barrier rib to electrically separate the plurality of first and second data electrodes.*

*45. A plasma display panel divided into a plurality of smaller screens and the plurality of smaller screens operating independently at the same time, comprising:*

*a first substrate having a plurality of common and scanning electrodes, said plurality of scanning electrodes being positioned parallel to said plurality of common electrodes;*

*a second substrate having a plurality of data electrodes, said plurality of data electrodes positioned perpendicular to the plurality of common electrodes and the scanning electrodes;*

*a plurality of first ribs between the first and second substrate; and*

*a plurality of cells, each cell positioned at an intersection where each of the plurality of data electrodes intersect with corresponding common and scanning electrodes, wherein*

*the plurality of data electrodes are divided for the purpose of dividing the plasma display panel, each of the plurality of data electrodes includes a first prescribed number of sub-electrodes, and the first prescribed number of sub-electrodes is electrically separated from one another.*

*46. The plasma display panel of claim 45, wherein the prescribed number of sub-electrodes are co-planar on the second substrate.*

*47. The plasma display panel of claim 45, wherein the plurality of common and scanning electrodes are co-planar on the first substrate.*

*48. The plasma display panel of claim 45, wherein an insulating layer is formed on the plurality of common and scanning electrodes.*

*49. The plasma display panel of claim 45, wherein an insulating layer is formed on each of the first prescribed number of sub-electrodes.*

*50. The plasma display panel of claim 45, wherein phosphor is formed within each cell.*

*51. The plasma display panel of claim 45, wherein a plurality of smaller screens comprises a first smaller screen having a first group of the first prescribed number of sub-electrodes, and a second smaller screen having a second group of the first prescribed number of sub-electrodes, the first and second group being configured as to allow the first and second screens to operate independently at the same time.*

*52. The plasma display panel of claim 45, wherein at least one of each common electrode is driven by at least one first sustaining pulse having a first prescribed pulse width (P1), and at least one of each scanning electrode is driven by at least one second sustaining pulse having a second prescribed pulse width (P2) and at least one scanning pulse having a third prescribed pulse width (P3), wherein a first prescribed time period (Ts) comprises at least P1+P2+P3.*

*53. The plasma display panel of claim 52, wherein each of the first, second and third pulse width is based on a first transition of a signal from a first potential to a second potential and a second transition of the signal from the second potential to the first potential.*

*54. The plasma display panel of claim 52, wherein each of the first prescribed number of sub-electrodes is driven by at least one data pulse.*

*55. The plasma display of claim 52, wherein Ts is not less than 4 microseconds.*

*56. The plasma display of claim 52, wherein Ts is determined based on the following:*

*Ts×(a number of scanning electrodes/a second prescribed number)×Nfs≦a prescribed time period based on a scanning mode, where Nfs is a number of sub-field.*

*57. The plasma display panel of claim 56, wherein the number of scanning electrodes is based on the first prescribed number of sub-electrodes, which equals 2.*

*58. The plasma display panel of claim 56, wherein the prescribed time period equals 1/60 seconds.*

*59. The plasma display panel of claim 58, wherein the second prescribed number equals 2.*

*60. The plasma display panel of claim 59, wherein the scanning mode is an interlaced scanning mode.*

*61. The plasma display panel of claim 56, wherein Ts increases as the first prescribed number increases.*

*62. The plasma display panel of claim 56, wherein Nfs equals 8.*

*63. The plasma display panel of claim 45, wherein a time period (Td) for transferring one bit of information is based on the following:*

*(a first screen resolution of the plasma display panel in a direction of the plurality of the data electrodes)×(a number of scanning electrodes/a second prescribed number)×(a number of bits for a prescribed gray scale)×Td<a prescribed time period based on a scanning mode.*

*64. The plasma display panel of claim 63, wherein the number of scanning electrodes is based on the first prescribed number of sub-electrodes, which equals 2.*

*65. The plasma display panel of claim 63, wherein the prescribed time period equals 1/60 seconds and the second prescribed number equals 2.*

*66. The plasma display panel of claim 65, wherein the scanning mode is an interlaced scanning mode.*

*67. The plasma display panel of claim 63, wherein Td increases as the first prescribed number increases.*

*68. The plasma display panel of claim 63, wherein the number of bits equals 8.*

*69. The plasma display panel of claim 45, wherein each of the first prescribed number of sub-electrodes is divided by a spaced distance from one another for electrical separation.*

*70. The plasma display panel of claim 45, wherein the plurality of common and scanning electrodes are divided at least once by a spaced distanced such that the plurality of common and scanning electrodes comprises a plurality of common electrode groups and the plurality of scanning electrodes comprises a plurality of scanning electrode groups.*

*71. The plasma display panel of claim 45, wherein the plurality of common and scanning electrodes are divided by at least one barrier rib, thereby further dividing the plasma display panel.*

*72. The plasma display panel of claim 45, wherein the plurality of data electrodes is divided by a barrier rib.*

*73. A plasma display panel divided into a plurality of smaller screens and the plurality of smaller screens operating independently at the same time, comprising:*

*a plurality of common electrodes positioned parallel to a plurality of scanning electrodes, the plurality of common and scanning electrodes being arranged on a first substrate, and a common electrode and a scanning electrode forming an electrode pair;*

*a plurality of data electrodes positioned perpendicular to the plurality of common and scanning electrodes and arranged on a second substrate; and*

*a plurality of cells, each cell being positioned at an intersection where each of the plurality of data electrodes intersect with the electrode pair, wherein the plurality of data electrodes are divided for the purpose of dividing the plasma display panel, wherein*

*each of the plurality of data electrodes is separated into a first sub-electrode and a second sub-electrode, an end of each of said first and second sub-electrodes is electrically separated from one another by a span of a first prescribed distance, and*

*electrodes on the first substrate, which are closest to the span, are spaced from one another by a second prescribed distance, said first prescribed distance is smaller than the second prescribed distance.*

*74. A plasma display panel comprising:*

*a common electrode positioned parallel to a scanning electrode;*

*a data electrode positioned perpendicular to the common electrode and the scanning electrode;*

*a cell positioned at the intersection where the common electrode and the scanning electrode intersect with the data electrode; and*

*the data electrode being divided for the purpose of dividing the screen into a plurality of smaller screens, wherein a common electrode signal is applied to the common electrode when the cell is selected, and the same common electrode signal is applied when the cell is not selected and wherein the data electrode is divided by a separation having a prescribed distance and a largest width of a barrier rib is substantially the same as the prescribed distance.*

*75. The plasma display panel of claim 1 or 74, wherein the barrier rib is within a span of the separation.*

*76. The plasma display panel of claim 8, wherein the plurality of data electrodes is divided by a separation having a prescribed distance, and a largest width of a barrier rib is substantially the same as the prescribed distance.*

*77. The plasma display panel of claim 8, wherein the plurality of data electrodes is divided by a separation and a barrier rib is located between the separation.*

*78. The plasma display panel of claim 76 or 77, wherein the barrier rib is within a span of the separation.*

*79. The plasma display panel of claim 8, wherein a common signal is applied to the plurality of common electrodes at the same time.*

*80. The plasma display panel of claim 79, wherein the common signal is a sustain pulse.*

*81. The plasma display panel of claim 45, wherein the plurality of data electrodes is divided by a separation having a prescribed distance, and a largest width of a barrier rib is substantially the same as the prescribed distance.*

*82. The plasma display panel of claim 45, wherein the plurality of data electrodes is divided by a separation and a barrier rib is located between the separation.*

*83. The plasma display panel of claim 81 or 82, wherein the barrier rib is within a span of the separation.*

*84. The plasma display panel of claim 45, wherein a common electrode signal is applied to the plurality of common electrodes at the same time.*

*85. The plasma display panel of claim 84, wherein the common electrode signal is a sustain pulse.*

*86. The plasma display panel of claim 73, wherein a largest width of a barrier rib is substantially the same as the first prescribed distance.*

*87. The plasma display panel of claim 73, wherein a barrier rib is located between the span.*

*88. The plasma display panel of claim 86 or 87, wherein the barrier rib is within the span.*

*89. The plasma display panel of claim 73, wherein a common electrode signal is applied to the plurality of common electrodes at the same time.*

*90. The plasma display panel of claim 89, wherein the common signal is a sustain pulse.*

*91. The plasma display panel of claim 1, 4, or 73, wherein the common electrode is driven by at least one first sustaining pulse having a first prescribed pulse width (P1), and the scanning electrode is driven by at least one second sustaining pulse having a second prescribed pulse width (P2) and at least one scanning pulse having a third prescribed pulse width (P3), wherein a first prescribed time period (Ts) comprises at least P1+P2+P3.*

*92. The plasma display panel of claim 91, wherein Ts is determined based on the following Ts×(a resolution in a direction of the scanning electrodes/a prescribed number)×Nfs≦a prescribed time period based on a scanning mode, where Nfs is a number of sub-field.*

*93. The plasma display panel of claim 91, wherein Ts is at least 5.5 microseconds.*

*94. The plasma display panel of claim 91, wherein Ts is determined based on the following:*

*Ts×(a resolution in a direction of the scanning electrode/a prescribed number)×Nfs≦a prescribed time period based on a scanning mode, where Nfs is a number of sub-field.*

*95. The plasma display panel of claim 15, wherein the prescribed time period equals 1/60 seconds.*

*96. The plasma display panel of claim 95, wherein the prescribed number equals 2.*

*97. The plasma display panel of claim 95, wherein the scanning mode is an interlaced scanning mode.*

*98. The plasma display panel of claim 95, wherein Nfs equals 8.*

*99. The plasma display panel of claim 1, 4, or 73, wherein a time period (Td) for transferring one bit of information is based on the following:*

*(a first screen resolution of the screen in a direction of the data electrode)×(a first resolution in a direction of the scanning electrode/a prescribed number)×(a number of bits for a prescribed gray scale)×Td<a prescribed time period based on a scanning mode.*

*100. The plasma display panel of claim 99, wherein the first screen resolution is 1280 and the second screen resolution of the screen is 1024.*

*101. The plasma display panel of claim 99, wherein the prescribed time period equals 1/60 seconds.*

*102. The plasma display panel of claim 99, wherein the prescribed number equals 2.*

*103. The plasma display panel of claim 99, wherein the scanning mode is an interlaced scanning mode.*

*104. The plasma display panel of claim 1, wherein the common electrode signal is a sustain pulse.*

* * * * *